United States Patent [19]

Williams et al.

[11] Patent Number: 5,037,103

[45] Date of Patent: Aug. 6, 1991

[54] GOLF CLUB WITH IMPROVED HANDLE

[76] Inventors: Richard Williams, 158 Dafrack Dr., Lake Hiawatha, N.J. 07034; Martin Wasacz, 13 Irving Terr., Bloomfield, N.J. 07003

[21] Appl. No.: 534,887

[22] Filed: Jun. 8, 1990

[51] Int. Cl.[5] ..... A63B 53/02; A63B 53/14

[52] U.S. Cl. ..... 273/183 R; 273/80 C; 273/81 D; 273/81.3; 273/164

[58] Field of Search ..... 273/183 R, 183 B, 81 R, 273/81 B, 81 D, 80 C, 81.3, 186 R, 186 A, 187 R, 188 R, 191 R, 191 B, 193 A, 193 B, 194 B, 178 A, 178 B, 176 H, 77 R, 164, 190 R, 190 R, 190 A, 190 B, 190 C, 190 D

[56] References Cited

U.S. PATENT DOCUMENTS

| | | | |
|---|---|---|---|
| 1,919,221 | 7/1933 | James | 273/81.3 |
| 2,325,525 | 7/1943 | Luckenbill | 273/81.3 |
| 3,341,203 | 9/1967 | Brill | 273/81.3 |
| 3,448,981 | 6/1969 | Anweiler | 273/80 C |
| 3,833,223 | 9/1974 | Shulkin | 273/194 R |
| 4,215,860 | 8/1980 | Nakamatsu | 273/81 R |
| 4,506,888 | 3/1985 | Naroozzi, Jr. | 273/80 C X |
| 4,880,240 | 11/1989 | Lewis | 273/81 B X |

*Primary Examiner*—William H. Grieb
*Attorney, Agent, or Firm*—Thomas L. Adams

[57] ABSTRACT

A golf club is arranged for separate gripping by a pair of hands. The club has a club head and a pair of parallel handles spaced to bring the hands approximately contiguous when separately gripping the handles. The club also has a connector for connecting between the parallel handles and the club head. The connector has a joint connected between a shaft and the parallel handles. This shaft has a lower and an upper portion. The lower portion is connected to the club head. The shaft is parallel to the handles.

15 Claims, 5 Drawing Sheets

FIG. 4
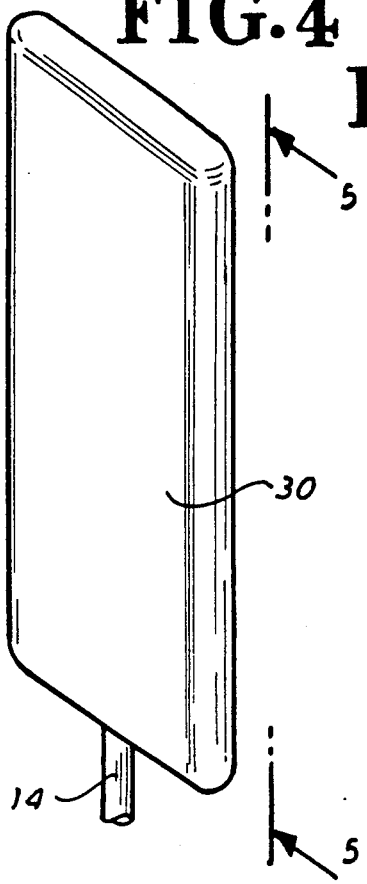
FIG. 5
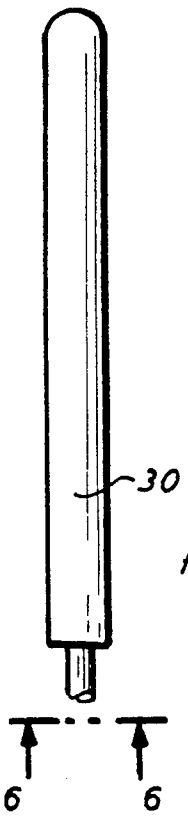
FIG. 6
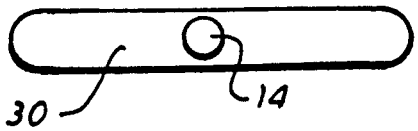
FIG. 7
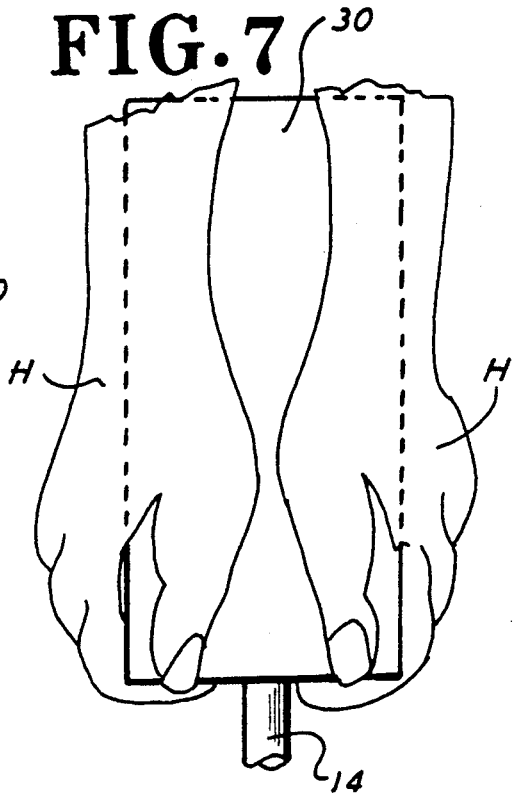
FIG. 9
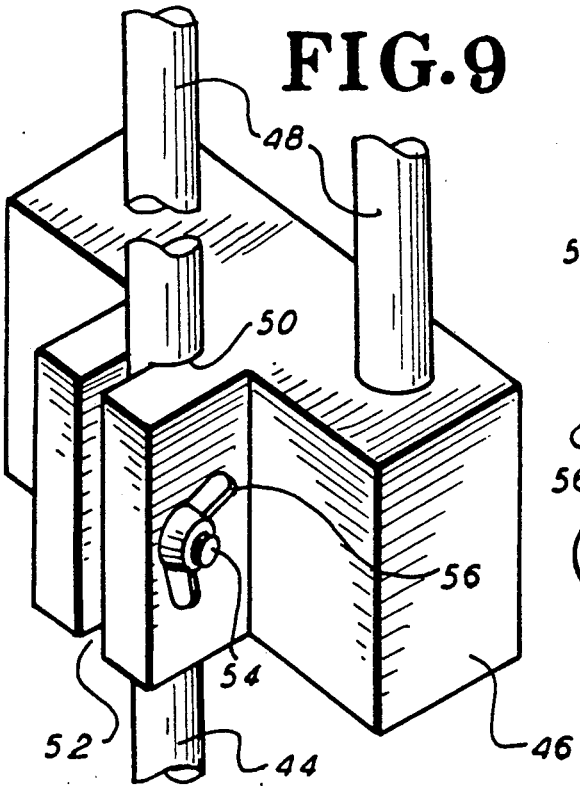
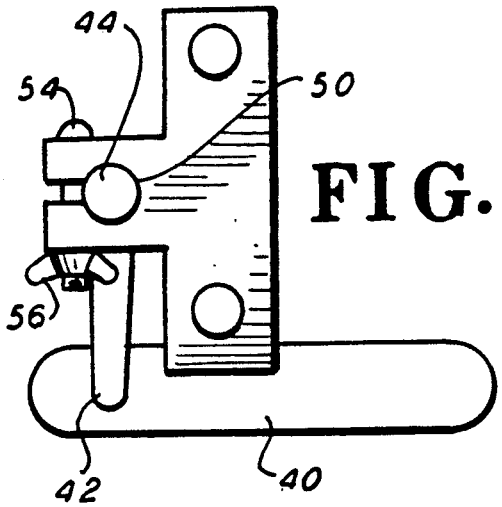
FIG. 8

FIG. 14
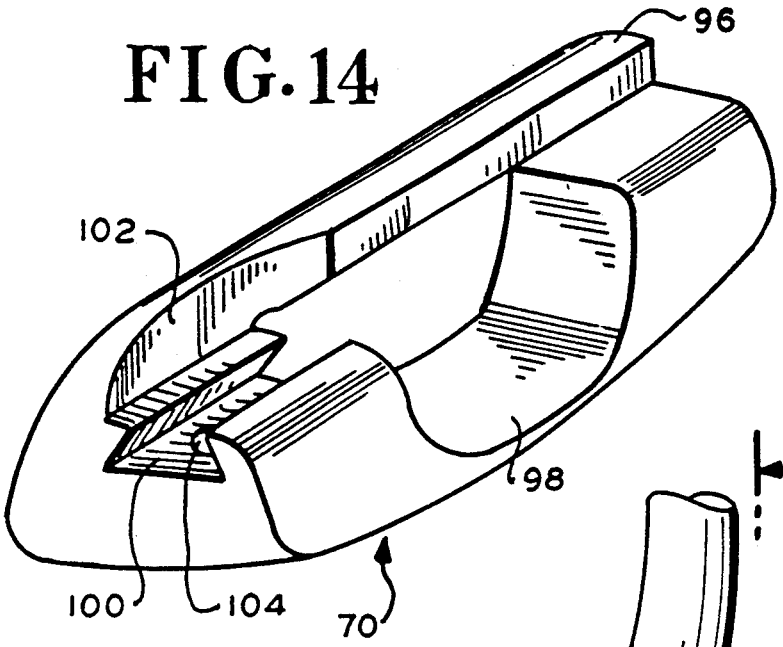
FIG. 12
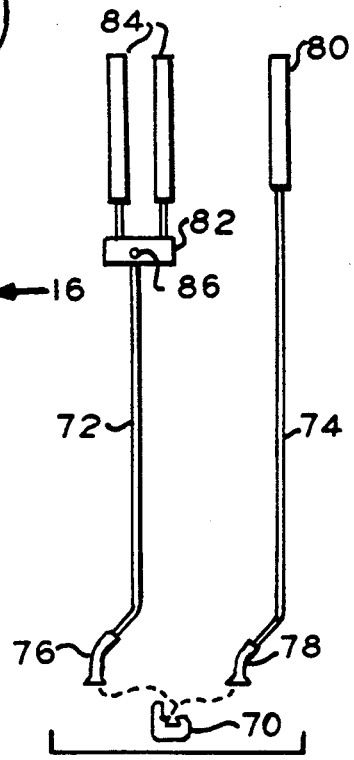
FIG. 13
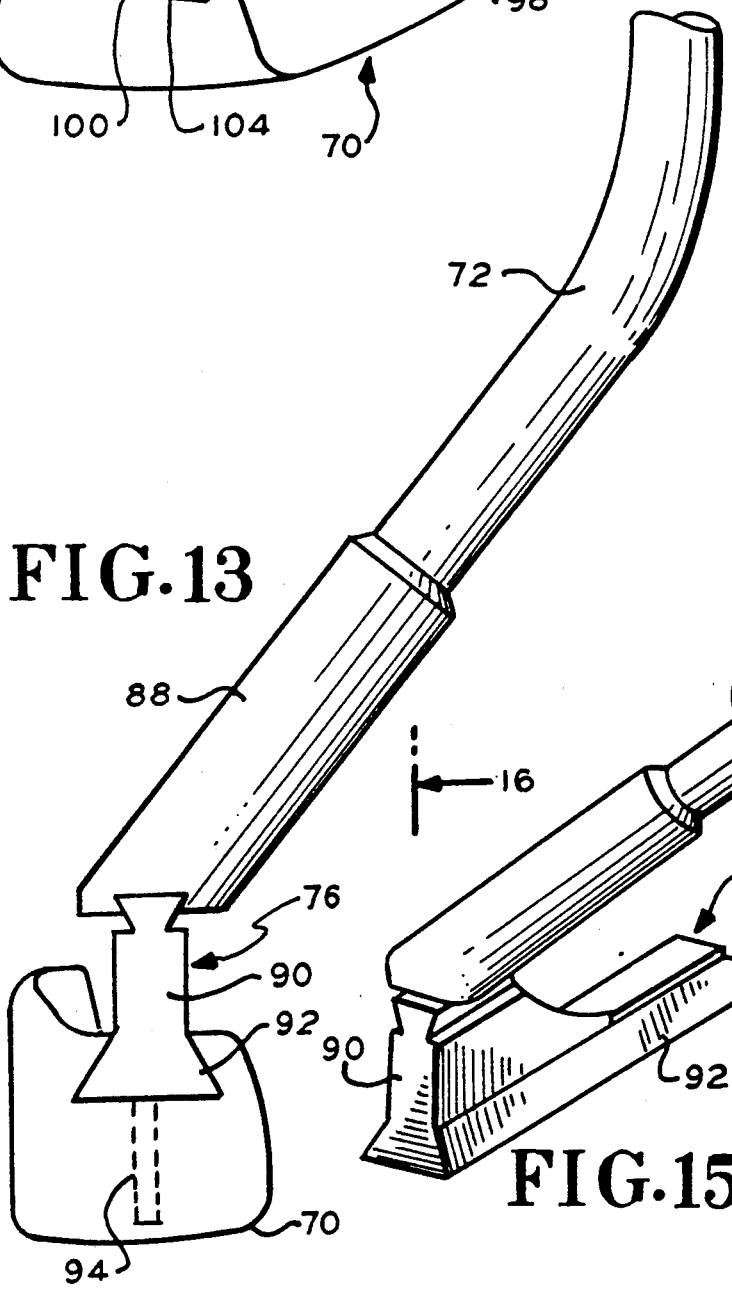
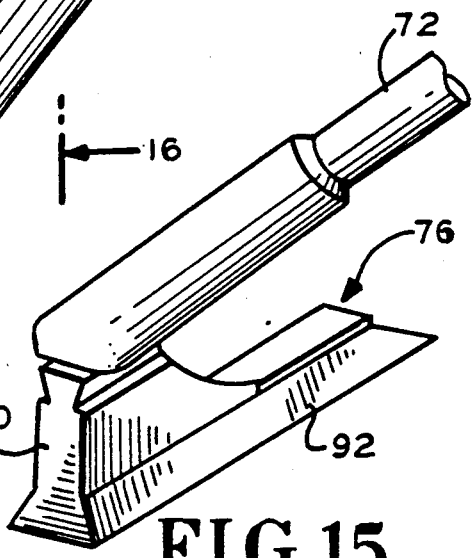
FIG. 15
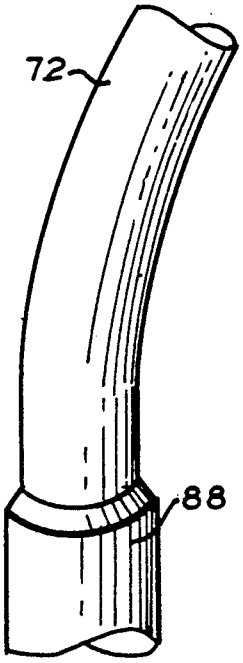
FIG. 16

GOLF CLUB WITH IMPROVED HANDLE

BACKGROUND OF THE INVENTION

The present invention relates to golf clubs and, in particular, to clubs having an improved handle to allow a larger than usual separation between the hands of the player.

When using a golf club, the player's hands normally grip along the same axis, since there is a single shaft having a handle. This requires the player to place one hand above the other, a grip that is unnatural. Because of the unnatural placement of hands, there is an increased tendency to turn the club along its axis by rolling the wrists. This tendency is especially detrimental for putting. A proper putting stroke involves swinging primarily with the shoulders and upper body, without using the wrist to affect the stroke.

In order to avoid the unnatural hand placement of conventional golf clubs, it has been suggested to use a parallel pair of widely spaced handles. See for example, U.S. Pat. No. 1,919,221. Because of the wide spacing, however, any training done with this known club is not readily transferred when the player uses a single handled club. The large handle-to-handle spacing of the prior art club has a feel which is too different from the single handled club.

In addition, the prior art has not recognized the importance of training with a dual handled club for putting. Training for putting requires a proper feel to accomplish a proper putting stroke. Also with putting, the alignment between handles and the face of the putter head is important. The prior art has neither taught the use of a dual handled putter nor taught what the proper alignment ought to be with a dual handled putter.

Also there has been no suggestion by the prior art of how a single handle can create the same feel as the dual handled golf club.

Accordingly, there is a need for an improved handle for a golf club which allows training with the hands separated more than usual, but not so wide as to defeat the training purpose.

SUMMARY OF THE INVENTION

In accordance with the illustrative embodiments demonstrating features and advantages of the present invention, there is provided a golf club arranged for separately gripping by a pair of hands. The golf club includes a club head and a pair of parallel handles spaced to bring the hands approximately contiguous when separately gripping the handles. The golf club also includes a connecting means for connecting between the parallel handles and the club head. The connecting means has a shaft and a joint connected between the shaft and the parallel handles. The shaft has a lower and an upper portion. This lower portion is connected to the club head while the shaft is parallel to the handle.

In one embodiment of the same invention, a grip is arranged for separately gripping a golf club with a pair of hands. This golf club has a shaft connected to a club head. The grip includes a pair of parallel handles spaced to bring the hands approximately contiguous when separately gripping the handles. The grip includes a connecting means for connecting between the shaft and the parallel handles and for keeping the handles radially spaced from and parallel to the shaft.

Still another embodiment of the same invention provides a golf club arranged for separate gripping by a pair of hands. The golf club includes a club head and a handle having a width approximately equal to or greater than the palm width of the hands. The width of the handle exceeds its thickness and is sized to bring the hands approximately contiguous when gripping the handle along opposite edges. The club includes a shaft having a lower and an upper portion. This lower portion is connected to the club head and the upper portion is connected to the handle.

By employing apparatus of the foregoing type, an improved golf club is provided. This golf club enables a player to grip the golf club with the hands spaced more widely apart than usual, yet not so widely apart as to destroy the feel associated with gripping a club having a single narrow handle. In one preferred embodiment, a pair of handles are connected to a rectangular connecting block. The handles are coplanar with the lower shaft that connects to the club head. The handles are equidistantly spaced from the axis of the lower shaft connecting to the club head.

A preferred embodiment works with a putter head that is offset away from the driving direction, so that the center of a golf ball, when struck, is behind the axis of the lower shaft of the golf club.

In another embodiment, a pair of handles extend upwardly from a connecting block that can be clamped to a conventional golf club, such as a putter. The dual handles are secured in a T-shaped block, where a compressible bore can be clamped about the conventional club shaft. This bore is equidistantly spaced from the parallel handles.

Another embodiment uses a single paddle-like handle instead of two separate handles. This paddle-like handle is wider than it is thick. Consequently, the hands of the player are spaced more than usual, but still are approximately contiguous. Thus, a feel that is appropriate for training is achieved.

BRIEF DESCRIPTION OF THE DRAWINGS

The above brief description as well as other objects, features, and advantages of the present invention will be more fully appreciated by reference to the following detailed description of presently preferred but, nonetheless, illustrative embodiments in accordance with the present invention, when taken in conjunction with the accompanying drawings, wherein:

FIG. 4 is a perspective view of a handle that is an alternate to the dual handles of FIG. 2;

FIG. 5 is an elevational view taken along line 5—5 of FIG. 4;

FIG. 6 is a bottom view of the handle taken along lines 6—6 of FIG. 5;

FIG. 7 is an elevational view of the handle of FIG. 4 shown gripped by a player;

FIG. 8 is a top view of a grip connected to a conventional putter in accordance with the principles of the present invention;

FIG. 9 is a detailed perspective view of the connecting means illustrated in FIG. 8;

FIG. 12 is an assembly drawing showing a club head with alternate club shafts connectable thereto;

FIG. 13 shows an end view of the end of one of the shafts of FIG. 12 connected to a club head;

FIG. 14 is a perspective view of the head of FIG. 13;

FIG. 15 is a detailed perspective view of the club of FIG. 13 with the club head removed; and FIG. 16 is a side view along lines 16—16 of FIG. 13.

DETAILED DESCRIPTION OF THE PREFERRED EMBODIMENTS

Figure 1:
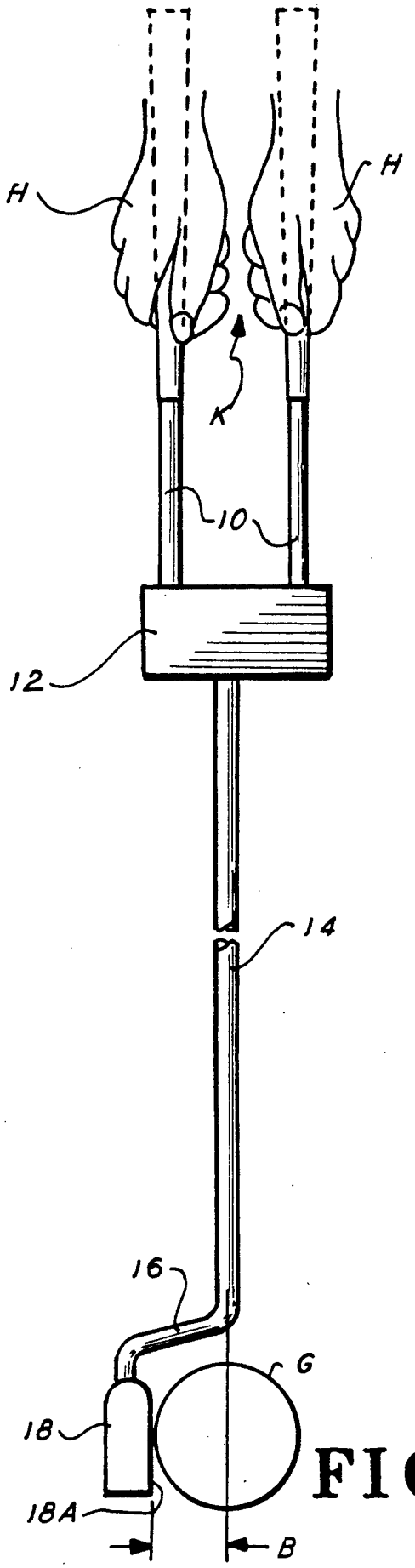
FIG. 1 is a side elevational view of a golf club being used and in accordance with the principles of the present invention.
Figure 2:
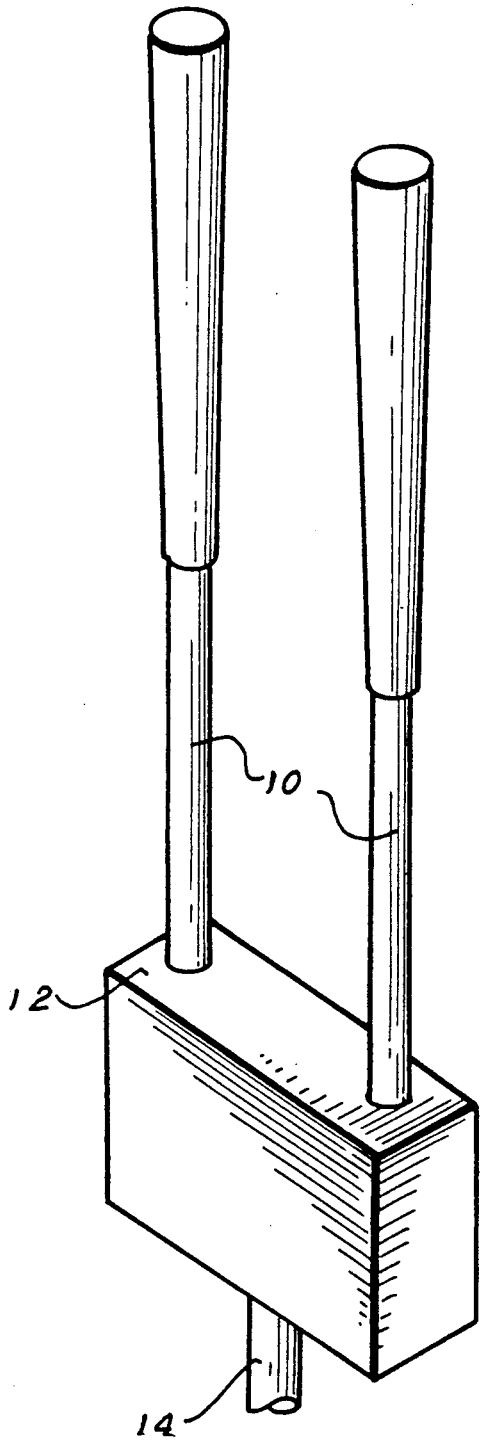
FIG. 2 is a perspective view of the handles and block illustrated in FIG. 1.

Referring to FIGS. 1 and 2, a golf club is shown having a pair of parallel handles 10 mounted in upper bores in a block 12, also referred to as a connecting means. This block 12 is a joint for connecting the parallel handles 10 to a shaft 14. Shaft 14 is mounted in a lower bore in block 12. Block 12 may be a molded plastic structure although other materials may be used instead.

The lower portion of shaft 14 has a jog 16 to displace putter head 18 rearwardly by the dimension B. Dimension B is chosen such that at the moment of contact with golf ball G, its center is displaced from the axis of the upper portion of shaft 14. In this embodiment, the overall length of the golf club in FIG. 1 is 35 inches, with the handles 10 being about 10¾ inches long. Dimension B is approximately 0.840 inches. In this embodiment, block 12 is a rectangular solid dimensioned 3.0"×1.5"×0.75".

It is significant to note that the center-to-center spacing of handles 10 is 2⅛ inches. With such a dimension, the knuckles K of hands H are approximately contiguous. In preferred embodiments, the handles should be spaced to accommodate the size of the particular player's hands, it being desirable to place the knuckles in a position where they are just touching or almost touching. Accordingly, the center-to-center spacing of the handles 10 can be varied, depending upon the size of the player's hands. It will also be noted that the length of handles 10 can be varied, although it is desirable to keep the overall length consistent with conventional golf clubs. Also, while putter head 18 is shown, it will be appreciated that in other embodiments an iron or driver head may be used instead. Indeed, any conventional club head may be substituted for putter head 18.

Figure 3A:
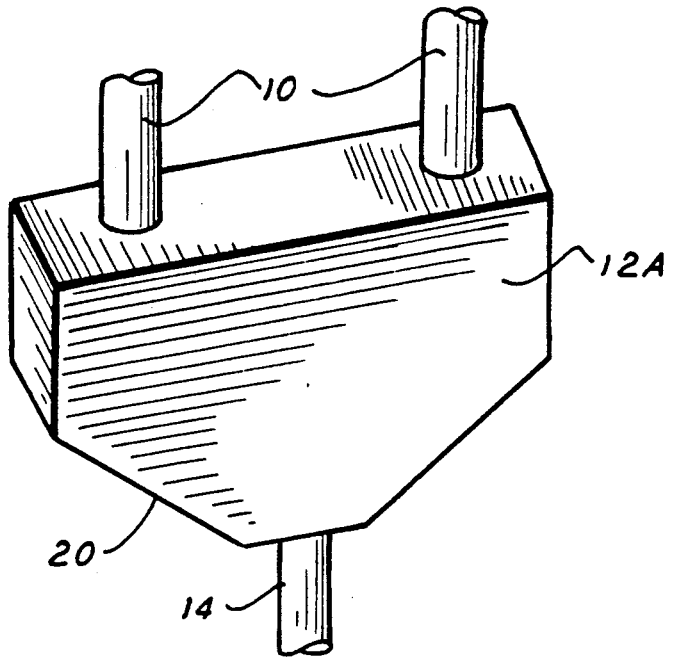
FIGS. 3A, 3B, and 3C are perspective views of connecting means that are alternates to that shown in FIG. 2.

Referring to FIG. 3A, it shows a block 12A which is in alternate to the other block (block 12 of FIG. 1). Block 12A, again, has previously illustrated handles 10 mounted in upper bores in block 12A. Also, shaft 14 is mounted in a lower bore of block 12A. Block 12A has bevelled corners 20 to provide a streamlined appearance and to reduce and conserve the amount of material.

Figure 3B:
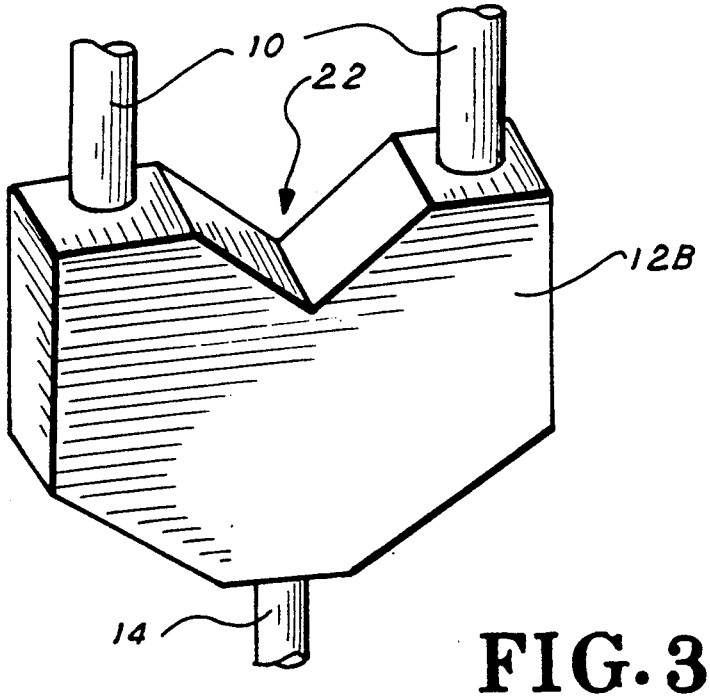

FIG. 3B shows a block 12B similar to the block of FIG. 3A, except that it has between handles 10 a notch 22 to give block 12B a V-shaped structure.

Figure 3C:
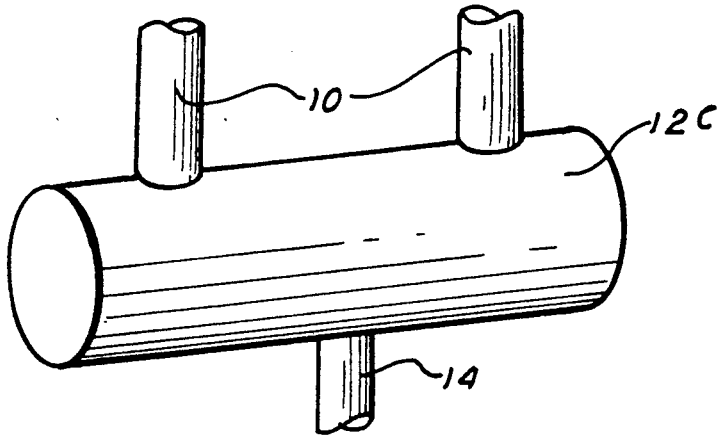

FIG. 3C shows an alternate block 12C that is a solid cylinder having an axis perpendicular to the lengths of handles 10 and shaft 14.

Referring to FIGS. 4, 5, and 6, an alternate handle 30 is shown having a paddle-like structure. In a preferred embodiment, the width of handle 30 can be 2 to 5 inches, depending upon the desired hand-to-hand spacing and the size of the player's hands. The thickness of handle 30 is substantially less than the width and can be nominally ¾ inch, although other thicknesses may be employed. The length of handle 30 can be varied; for example, between 6 to 10¾ inches.

Emerging from the bottom of handle 30 is shaft 14, which is identical to the shaft previously illustrated. Shaft 14 terminates in a club head such as a putter head. As before, it is desirable to keep the overall length of the golf club consistent with the lengths of conventional golf clubs. Handle 30 is made of a molded plastic, although other materials may be employed. Preferably, handle 30 is covered with a grip-improving material such as leather.

FIG. 7 illustrates the preferred manner of holding handle 30. The thumbs of hands H just reach past the bottom edge of handle 30. The length of handle 30 affects the amount of interaction between the handle and the player's wrists. As noted for the other embodiments, the length can be varied very considerably and this will change the total feel of the club.

Referring to FIGS. 8 and 9, a conventional putter is shown having a putter head 40 connecting to a shaft 44 having a jog 42, similar to the jog illustrated in FIG. 1. A grip is shown herein as an accessory having a connecting means 46 in the shape of a rectangular block having a T-shaped plan. Emerging from upper bores in block 46 are parallel handles 48 structured the same as handles 10 of FIG. 1. Block 46 has a lower bore 50 that is open at each end to allow passage of shaft 44. It will be noted, therefore, that block 46 and its handles 48 comprise an accessory that can be attached to a conventional golf club. Bore 50 is bordered by a longitudinal split 52 which allows the material of block 46 on opposite sides of bore 50 to be compressed. Such compression is shown exerted by a clamping means in the form of a bolt 54, held in place by wing nut 56. By tightening wing nut 56, longitudinal slit 52 is constricted together with bore 50. Slit 52 is sufficiently wide so that the shaft 54 can be removed through slit 52 when the bolts 54 and wing nut 56 are removed.

The golf clubs illustrated herein are all used in a similar fashion. For example, the club of FIG. 1 is used by gripping the handles 10 as illustrated, keeping the knuckles K so that they are just touching or almost touching. The wrists and hands are separated, however, to produce a slightly different feel which tends to stop the player from turning his wrists when he is putting or otherwise using a golf club. In all other respects, the stance and the manner of the swing is the same.

It will be appreciated that the offset of jog 16 changes the point of impact so that the shaft 14 is at its downwardmost position or slightly advanced from the downwardmost position. This geometric relation helps improve the accuracy of the putt since the arms and shoulders of the golfer will more likely be squared at the time that the ball G is struck.

Figure 10:
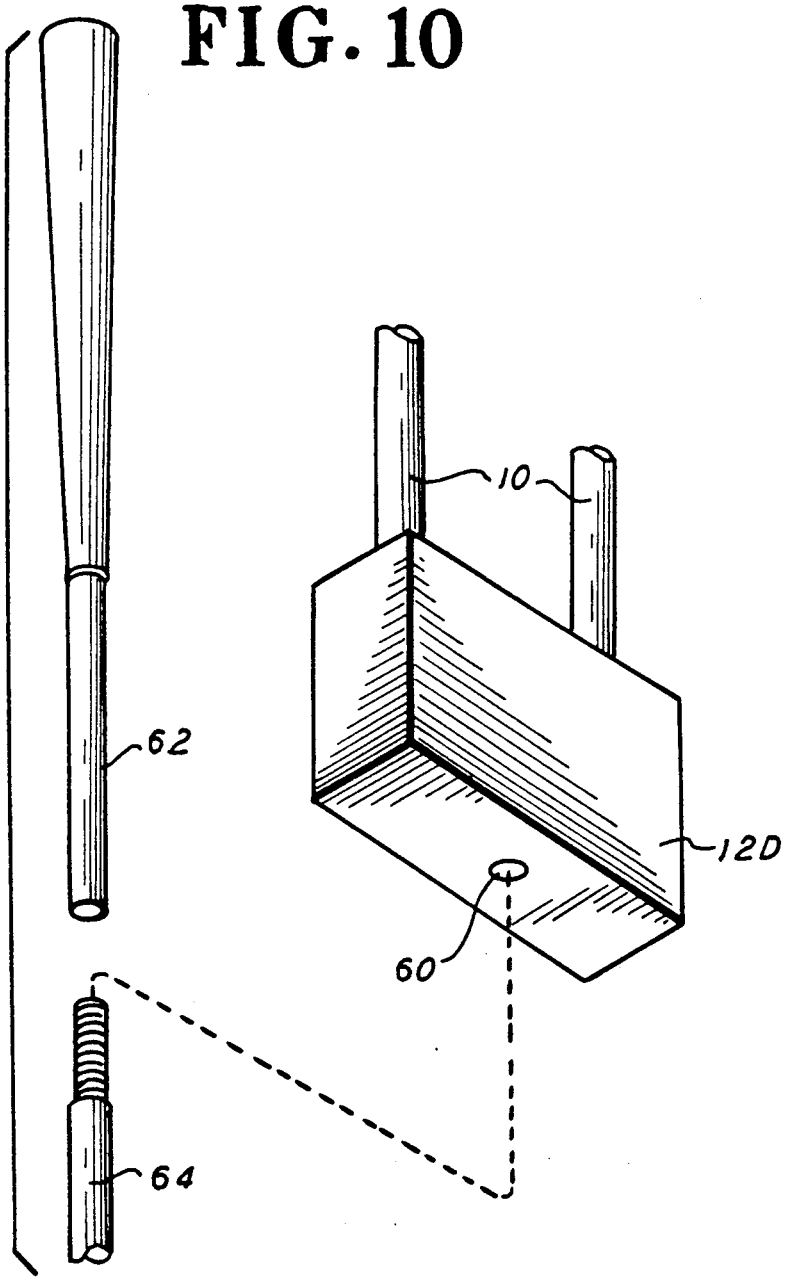
FIG. 10 is a detailed perspective view of a golf club that is an alternate to that of FIG. 2.

Referring to FIG. 10, it shows an alternate block 12D made of a material similar to that previously described in connection with FIG. 1. Extending upwardly from block 12D are a pair of parallel handles 10 identical to the handles previously described in connection with FIG. 1. The bottom of block 12D has in it internally threaded hole 60. A golf club shaft 64 may be threaded into hole 60. Shaft 64 terminates in a putter head identical to that described in connection with FIG. 1. Being threaded, shaft 64 can be removed from block 12D. An accessory handle 62 is shown with a hollow shank into which the thread end of shaft 64 can be screwed.

Constructed in this fashion, the club 64 can be used with either two handles or with a single handle 62. This feature enables one to train with two handles and play in competition with a single handle but always using the same putter head. This feature minimizes the disturbance of the player's stroke when switching from a double to a single handle. Thus the training on the double handle club is transferable.

Figure 11:
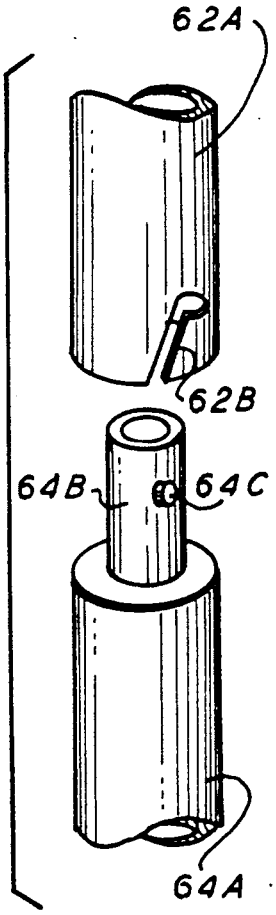
FIG. 11 is a detailed view of a joint for a golf club which is an alternate to that of FIG. 10.

Referring to FIG. 11, an alternate connection is shown for connecting shaft 64A to handle 62A. Shaft 64A is identical to previously illustrated shaft 64 of FIG. 10, except that the upper end is formed into a reduced-diameter, cylindrical tip having a sidewardly projecting button 64C. The tip 64B can be slid into handle 62A. Handle 62A is identical to previously illustrated handle 62 of FIG. 10, except that its lower end is not threaded and has instead a slot 62B. Slot 62B is designed to receive button 64C. Thus, the tip 64B can be pushed into the handle 62A and turned slightly, at which time it will lock into position. This arrangement has the advantage that there is a fixed angular relationship between handle 62A and shaft 64A. While a button slot is shown in FIG. 11, other arrangements are possible, including the use of set crews or locking pins to hold together the shaft and handle.

This connection can be altered in various ways. For example, the single or double handle can be secured to the shaft by a recessed set screw. For the double handle, the set screw is in the block. For the single handle, the set screw is in a collar. In either case, the shaft can have a flanged stud with a key matching a keyway in the block and collar.

FIG. 12 shows an alternate embodiment of the club, where a removeable club head 70 can be attached to either one of two alternate club shafts 72 or 74. The shafts 72 and 74 have dovetail fixtures 76 and 78, respectively, sized to fit in a corresponding dovetail groove in head 70. Shaft 74 has the usual construction and has a handle 80. Shaft 72 is similar to the club of FIG. 2 and includes an aluminum block 82 into which are pressed fit (and possibly welded) a pair of parallel handles 84. The shaft 72 can be secured to block 82 by an Allen screw 86. Block 82 may be a rectangular solid similar to the previous illustrated block (block 12 of FIG. 2).

Referring to FIGS. 13, 14 and 15, previously mentioned club head 70 is shown connected to shaft 72. Shaft 72 has an outward bend and connects to a cylindrical column 88, which is welded to the top of anvil 90. Anvil 90 has a top pedestal and a lower, flared dovetail 92. The dovetail 92 is taller than the central portion 90. The forward end of dovetail 92 is also tapered. Club head 70 is shown with a corresponding dovetail groove to receive dovetail 92. A recessed Allen screw 94 presses against dovetail 92 to secure head 70 to the anvil 76.

As shown in FIG. 14, head 70 is a block having curved corners and edges and an upper ridge 96. Weight is reduced by casting a cavity 98 in club head 70. Previously mentioned dovetail groove 100 travels parallel to the length of head 70 from one end to the cavity 98. A relief 102 cut into ridge 96 to allow clearance for the previously mentioned anvil. The hole 104 allows emergence of the previously mentioned Allen screw.

FIG. 16 shows a side view of shaft 72 and collar 88 along lines 16—16 of FIG. 13. This view shows that shaft 72 has a compound angle, that is, it appears to have a bend from either the side or end view of the club head.

It is to be appreciated that various modifications may be implemented with respect to the above described preferred embodiments. For example, the material for the blocks and the dimensions of the blocks can be altered, depending upon the desired structural rigidity, weight, etc. Furthermore, the dimensions of the handles can be altered depending upon the desired feel and the size of the player's hands. In addition, the handles can be covered with various materials to improve the coefficient of friction between the player's hand and the handle. Also, the type of club head can be varied and may include irons, drivers, sand wedges, etc.

Obviously, many modifications and variations of the present invention are possible in light of the above teachings. It is therefore to be understood that within the soope of the appended claims, the invention may be practiced otherwise than as specifically described.

What is claimed is:

1. A golf club arranged for separate gripping by a pair of hands, comprising:

a club head comprising a putter head;

a pair of parallel handles spaced to bring said hands approximately contiguous when separately gripping said handles, the spacing of said handles remaining fixed notwithstanding force applied thereto by bare hands; and a connecting means for connecting between said parallel handles and said club head, said connecting means connecting said handles at the ends proximal said club head to keep clearance between the handles outwardly beyond the ends of said handles proximal said club head up to and including the ends of said handles distal said club head, said connecting means comprising:

a shaft having a lower and an upper portion, said lower portion being connected to said club head, said shaft being parallel to said handles and being radially spaced from said pair of handles, the central axes of said handles and said upper portion of said shaft being coplanar, said shaft having a jog in said lower portion to position the plane of said putter head parallel to but out of alignment with the axis of said upper portion of said shaft, said putter head having a front face that is rearwardly spaced out of alignment from the axis of said upper portion of said shaft by at least a distance equivalent to the radius of a golf ball; and a joint connected between said shaft and said parallel handles, said joint including a block having a pair of upper parallel bores and a lower bore, said handles being separately mounted in said upper bores, said upper portion of said shaft being mounted in said lower bore.

2. A golf club according to claim 1 wherein said block is rectangular.

3. A golf club according to claim 2 wherein said block is rectangular and has two lower corners that are bevelled.

4. A golf club according to claim 3 wherein said block is V-shaped.

5. A golf club according to claim 4 wherein said block is cylindrical.

6. A golf club according to claim 5 wherein said lower bore is open at both ends, said shaft being positioned to emerge from both of said ends of said lower bore.

7. A golf club according to claim 6 wherein said block includes clamping means for releasably holding said shaft in said lower bore.

8. A golf club according to claim 7 wherein said lower bore is bordered by a longitudinal slit dimensioned to allow compressive constriction of said lower bore, said clamping means being manually operable to compress said block about said longitudinal slit, so that said block can be alternately attached to or removed from said shaft.

9. A grip arranged for separately gripping a golf club with a pair of hands, said golf club having a shaft connected to a club head, said grip comprising:

a pair of parallel handles spaced to bring said hands approximately contiguous when separately gripping said handles; and a connecting means for connected between said shaft and said parallel handles and for keeping said handles radially spaced from and parallel to said shaft at an interhandle spacing that remains fixed notwithstanding force applied thereto by bare hands, said connecting means connecting said handles at the ends proximal said club head to keep clearance between the handles outwardly beyond the ends of said handles proximal said club head up to and including the end of said handles distal said club head; said connecting means including a block having a pair of upper parallel bores and a lower bore, said handles being separately mounted in said upper bores, said shaft being mounted in said lower bore, said lower bore being open at both ends to allow said shaft to emerge from opposite ends of said lower bore.

10. A golf club according to claim 9 comprising clamping means for releasably holding said shaft in said lower bore.

11. A golf club according to claim 10 wherein said lower bore is bordered by a longitudinal slit dimensioned to allow compressive constriction of said lower bore, said clamping means being manually operable to compress said block about said longitudinally slit, so that said block can be alternately attached to or removed from said shaft.

12. A golf club according to claim 11 wherein said club head is detachably secured to said connecting means.

13. A golf club according to claim 12 wherein said connecting means comprises a flared member, said club head having a converging slot sized to receive said flared member.

14. A golf club according to claim 13 further comprising setting means threadably attached to said club head to bear against said flared member.

15. A golf club according to claim 14 further comprising:

a shaft having a single handle; and a secondary flared anvil attached to the end of said shaft opposite said handle, said secondary flared anvil being sized to fit within the converging slot in said club head.

* * * * *